US005152154A

United States Patent [19]

Sullivan

[11] Patent Number: 5,152,154

[45] Date of Patent: Oct. 6, 1992

[54] FAN COIL UNIT

[76] Inventor: John T. Sullivan, 3910 Madison St., Hyattsville, Md. 20781

[21] Appl. No.: 790,877

[22] Filed: Nov. 12, 1991

[51] Int. Cl.[5] ..... F25D 21/14

[52] U.S. Cl. ..... 62/291; 220/571

[58] Field of Search ..... 62/285, 291, 288; 220/571

[56] References Cited

U.S. PATENT DOCUMENTS

| | | | |
|---|---|---|---|
| 2,909,043 | 10/1959 | Baker et al. | 62/285 |
| 3,379,329 | 4/1968 | Bryans et al. | 220/571 |
| 3,678,993 | 7/1972 | Pierce | 62/285 X |
| 4,000,779 | 1/1977 | Irwin | 62/288 X |
| 4,986,087 | 1/1991 | Sullivan | 62/291 |
| 5,071,027 | 12/1991 | Sullivan | 62/291 X |

*Primary Examiner*—William E. Tapolcai

*Attorney, Agent, or Firm*—Diller, Ramik & Wight

[57] ABSTRACT

A fan coil unit includes a primary pan having an opening through which air is directed by a fan within a fan housing suspended from the primary pan, the condensation coil is positioned above the primary pan through which the air passes causing condensation to collect upon and fall from the condensation coil into the primary pan and from the latter to a drain. A gap between a lower edge of the coil and the primary pan is bridged by a slidable connection which includes a plate and a resilient member to at all times urge the plate in a direction toward the coil.

20 Claims, 2 Drawing Sheets

FAN COIL UNIT

CROSS-REFERENCE TO RELATED APPLICATIONS

This invention is directed to a fan coil unit for commercial and residential air conditioners which can utilize a primary pan or convector tray of the type disclosed in U.S. Pat. No. 4,856,672 granted on Aug. 15, 1989 entitled CONDENSATION PAN/CONVECTOR TRAY FOR FAN COIL UNIT; U.S. Pat. No. 4,986,087 granted on Jan. 22, 1991 entitled FAN COIL UNIT; and Application Serial No. 07/642,767 filed Jan. 18, 1991 entitled A FAN COIL UNIT, now pending, all in the name of John T. Sullivan

BACKGROUND OF THE INVENTION

Residential and commercial air conditioners include as a part thereof a fan coil unit located within a housing which includes a coil through which refrigerant (liquid or gas, such as Freon) is pumped. The coil is normally supported above a condensation pan, convector tray or primary pan having one or more openings through which air is blown by one or more fans powered by motors which are supported below and from the primary pan. The air passing through the coil creates condensation on the coil which drips down, upon and into the primary pan and is then conducted by an appropriate outlet through a discharge pipe into a secondary pan and/or an associated drain.

Such conventional primary pans are generally made from galvanized metal and rust with relative ease. The fasteners (nuts and bolts and/or rivets) which connect the fan and/or fan housings to the primary pan are also generally made from metal and rust with equal relative ease. Once the primary pan and/or the fasteners rust, the condensation/water normally accumulating therein and draining properly therefrom, cannot do so. Instead the condensation/condensate can, for example, drip through the rusted galvanized primary pan and/or the fasteners into the underlying motor(s) which drives the fan(s) thereby causing the motor to short-out. The fan motor itself is normally supported by a metallic bracket and excessive rusting of the primary pans/metal fasteners will cause the fan support brackets to rust. Excessive rusting coupled with the centrifugal force of the fan motor would cause wobble, undesirable increased noise, and could eventually result in the brackets breaking or sufficiently loosening such that the motors and pans simply fall from the primary pan.

Excessive rust also blocks or reduces normal drainage which results in condensate accumulating in the primary pan to such an extent that the same overflows and causes damage. For example, conventional fan coil units are normally mounted on floors or in ceilings in hotels, motels and the like. Obviously, if a primary pan outlet becomes blocked and the condensate overflows, it will damage the ceiling and/or walls or the underlying floor and associated rugs. Accordingly, concern is not simply limited to fan coil unit damage, but extends to structural damage of the commercial or residential structure.

U.S. Pat. No. 4,856,672 and U.S. Pat. No. 4,986,087 each disclose structure which reduces rust and fungus growth associated with conventional galvanized metal primary pans and their associated sponge rubber seals o rubber gaskets which deteriorate and virtually breakdown into "dust" or similar extremely small particles which block or reduce the drainage of condensate from the pans and also results in fungus growth which in turn causes undesirable odors. The latter patents overcome these disadvantages by constructing the primary pans from synthetic polymeric material and utilizing a baffle to close a gap between the bottom of the condensation coil and the primary pan. Since the air which normally passes through this gap can now not pass therethrough due to the baffle, the efficiency of the overall unit is appreciably increases and the absence of metal, sponge rubber seals and rubber gaskets prevents deterioration which in turn reduces/eliminates the aforementioned damage.

The latter patents also avoid the fungus/odor problem by admixing biocides or preservative additives with the polymeric material from which the primary pans are formed. The latter reduces mildew, odors, etc.

SUMMARY OF THE INVENTION

The present invention is directed to additional novel and innovative structural aspects of a fan coil unit by not only providing a primary pan constructed from in situ molded polymeric/copolymeric material, but also providing in association therewith a novel bellows in the form of a plate which is slidable relative to the primary pan. A bottom or lower portion of the coil rests upon the plate or bellows and the plate is also urged in a direction away from the primary pan to essentially clamp the coil between the plate or bellows and an associated portion of the fan coil unit housing. Preferably the plate is urged away from a bottom wall of the primary pan by utilizing a strip of resilient foam polymeric/copolymeric material which is sandwiched between the plate and the bottom wall of the primary pan within a telescopic coupling therebetween. The telescopic coupling between a pair of upward projecting ribs of the primary pan bottom wall and a downwardly directed projection of the plate readily accommodates and locates the coil relative to the housing.

In further accordance with the invention the plate upon which the coil rests is also provided with one or more channels in which condensate can collect due to the temperature differential between an upper surface of the plate upon which the coil rests and a lower surface thereof. This condensate can then flow from the condensation channels through either or both opposite ends thereof into the primary pan and from the latter is then conducted to an appropriate drain.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
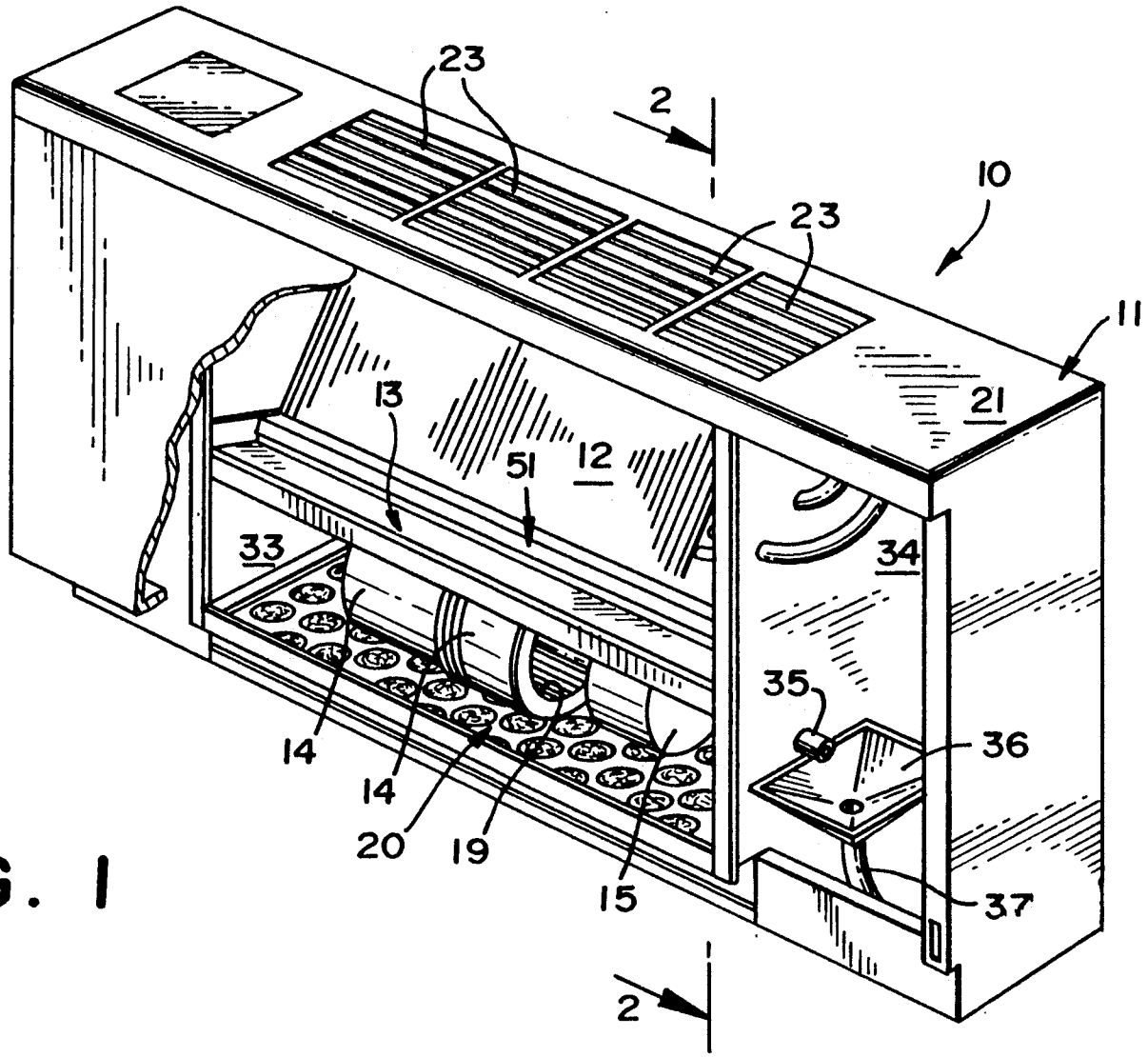
FIG. 1 is a perspective view of a fan coil unit constructed in accordance with this invention with a front wall thereof broken away for clarity, and illustrates a housing defining a chamber, a primary pan in the chamber, a coil above the primary pan, and a motor and fan/fan housing unit below and secured to the primary pan.

A novel fan coil unit of the present invention is illustrated in FIG. 1 of the drawings, and is generally designated by the reference numeral 10.

The fan coil unit 10 includes a housing 11, a condensation/ evaporation coil 12, a primary pan, condensation pan or convector tray 13, a fan housing 14, a fan motor 15 and a fan motor mounting bracket (not shown) securing the fan motor 15 to the primary pan 13.

The housing 11 defines a chamber (unnumbered) which is divided into a first or upper chamber portion 17 (FIG. 2) and a second or lower chamber portion 18 by the primary pan 13.

A conventional filter 20 spans an opening (unnumbered) formed in a bottom wall (not shown) of the housing 11 while a top wall 21 includes a plurality of grates or openings 23. When the fan motor 15 is energized, air is drawn from the exterior through the bottom wall (not shown), the filter 20 into and through the fan housing 14 through axial openings 19 (FIG. 1) thereof and through an opening 24 (FIG. 2) of the primary pan defined by an upstanding generally polygonal wall 25 which telescopically receives therein a like polygonally contoured outlet throat 26 of the fan housing 14. The air exits the throat 26 of the fan housing 14, enters the chamber 17 beneath the coil 12, and passes through the coil 12 in the manner indicated by the unumbered headed arrows associated therewith. As air passes through the condensation/evaporator coil 12, moisture condenses from the air forming condensate C which drips into the primary pan 13 from which it exits through a discharge port 27 projecting from a bottom wall 28 of the primary pan 13 at either or both of the opposite ends thereof adjacent side walls 33, 34 (FIG. 1) of the housing 11. A hose 35 (FIG. 1) passes through an opening (unnumbered) of the wall 34 and discharges into a secondary tray 36 which is connected to a drain by another pipe or conduit 37.

Figure 2:
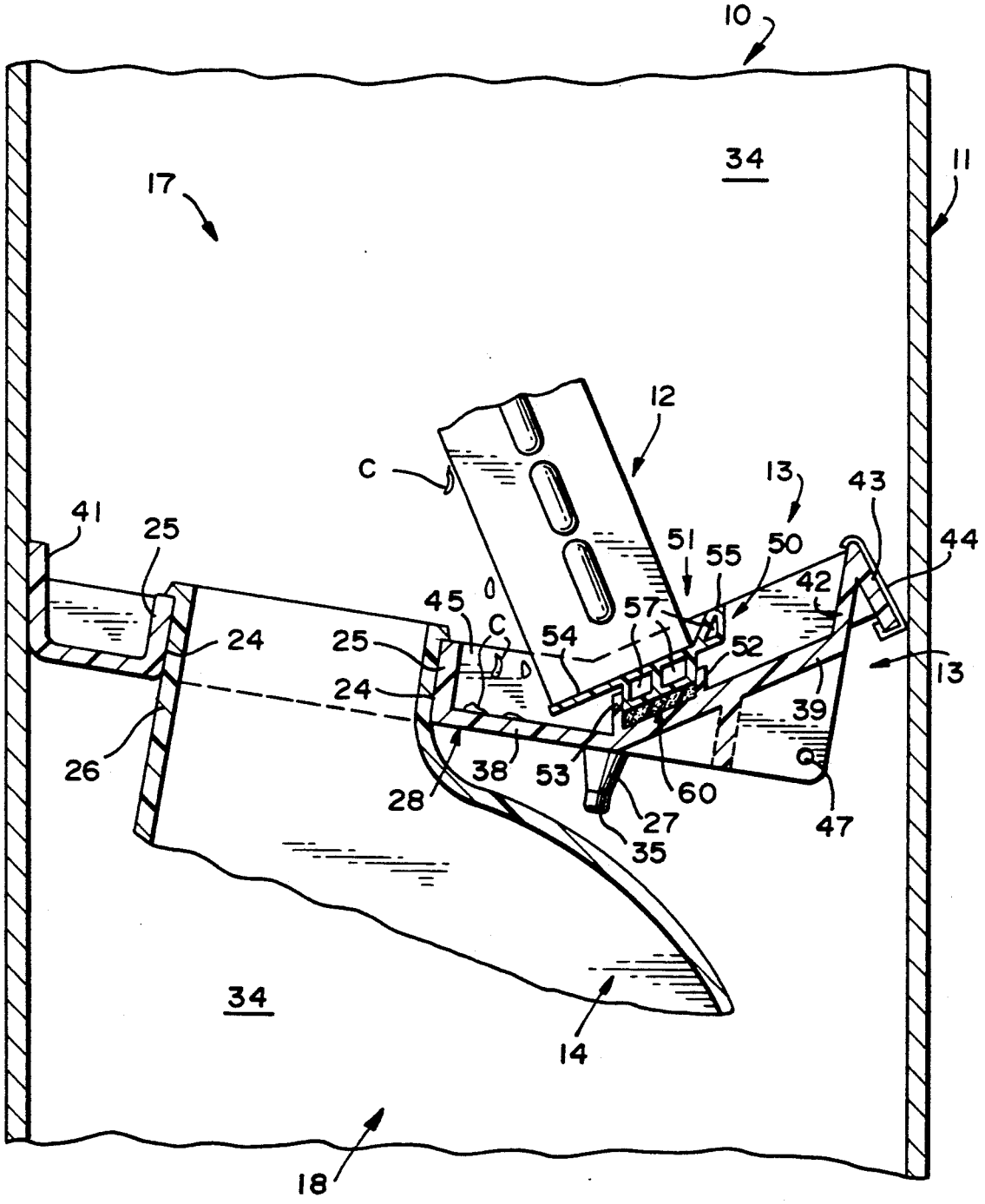
FIG. 2 is an enlarged cross-sectional view taken generally along line 2—2 of FIG. 1, and illustrates details of the primary pan and a slidably mounted baffle disposed between the coil and the primary pan.

The primary pan 13 includes a peripheral wall defined by opposite upstanding side walls 41, 42, the latter of which has a downturned flange 43 upon which is slidingly retained a metallic reinforcing member 44 which extends the length of the flange 43 between opposite end walls 45, 46 (FIGS. 2 and 2, respectively) of the pan 13. The metallic reinforcing member 44 prevent the primary pan 13 from deflecting longitudinally. Apertures 47 (FIG. 2) are provided in the end walls 45, 46 through which fasteners pass for securing the primary pan 13 to the walls 33, 34. An upper edge portion (unnumbered) of the side wall 41 is also suitably secured to frame members (not shown) of the housing 11, as more fully disclosed in the latter-identified patents and application, for additionally retaining the various components within the housing 11. The bottom wall 28 of the pan 13 further includes bottom wall portions 38, 39 which define a generally obtuse angle therebetween and with the intersection thereof define a low point of the primary pan 13 in its installed position (FIG. 2). The discharge port or spout 27 is, of course, located at the low point or the point of merger between the wall portions 38, 39 to facilitate complete drainage or condensation C from the primary pan 13.

Bridging means, generally designated by the reference numeral 50, close a gap (unnumbered) generally formed between the bottom or bottom portion of the coil 12 and the bottom wall 28 of the primary pan 13. The bridging means 50 is a relatively slidable connection defined by a plate or plate member 51 and a pair of generally parallel upstanding ribs 52, 53 projecting upwardly from the bottom wall portion 39 of the bottom wall 28. The plate member 51 spans the entire distance between the end walls 45, 46, as do the ribs 52, 53.

The plate member 51 is formed from synthetic polymeric/copolymeric plastic material which is vacuum-molded or extrusion-molded in a conventional manner. The hot polymeric/copolymeric plastic material is, however, admixed with preservatives which function to protect the polymeric material from attack by microorganisms. The microbiological attach of the polymer can lead to the loss of aesthetic appearance, mildew, odors, embrittlement and permanent product failure. Of several different preservative additives or biocides which are admixed with the polymeric material prior to the vacuum or extrusion molding thereof into the primary tray 13, the preferred biocides are 2-nm-octyl-r-isothiazolin-3-one and 10,10' bisphenoxarsine. As the condensation C droplets form and drop upon the plate member 51, the biocide therein will be leached or absorbed from the polymeric material and prevent the disadvantages heretofore noted, particularly fungus growth, mildew, odor, virus and bacteria formation.

The plate member 51 includes a base 54, an upstanding leg 55 and a downwardly directed projection 56. The upstanding leg 55 and the downwardly directed projection 56 include means 57 in the form elongated channels which extend generally the length of the plate member 51. When the fan coil unit is operating in the air conditioning mode, condensate C forms in the manner heretofore described. In addition, the relatively cold bottom or lower end portion of the coil 12 is in contact with the upper surface of the plate member 51, whereas opposite surfaces are subject to ambient temperature, and this temperature differential would normally cause condensation to form on the warmer surface of the plate member 51 opposite the surface contacted by the coil 12. However, because of the channels 57, some of the condensate formed on the lower surface of the plate member 54 will actually be formed within the channels 57 and will flow axially outwardly therefrom, and discharge immediately the discharge port or spout 27. Thus, this condensate will not collect upon the bottom wall 28 but will be immediately discharged, thus reducing the overall amount of condensate which might be collected by the primary pan 13 and accordingly reducing the adverse effects thereof.

Obviously, should the plate member 51 become worn or broken, it can be readily replaced simply by substituting another like plate member 51 therefor. Furthermore, over a considerable length of time the biocide within the plate member 51 can be bleached therefrom which, of course, offers two possible scenarios. The first is that biocide tablets or powder can simply be placed upon the bottom wall 28 of the primary pan 13, but more effective would be simply replacing the plate member 51 and substituting a new biocide-ladened plate member 51 therefor.

The plate member 51 also effectively closes the gap (unnumbered) between the bottom of the coil 12 and the bottom wall 28 of the primary pan 13 under a variety of misalignment or missizing situations. For example, if the coil 12 had to be replaced and another coil close to but not the identical size was used as a replacement, the plate member 51 could move inwardly or outwardly relative to and between the ribs. However, if the coil 12 were shorter (vertically) than that illustrated, the plate member 51 would have to be urged upwardly, and means generally designated by the reference numeral 60 in the form of a resilient strip of foam polymeric/-copolymeric material is sandwiched between the projection 56 of the plate member 51 and the wall portion 39 of the bottom wall 28 between the ribs 52, 53 of the latter. The strip of compressible foam material 60 is preferably fully compressed when installed and, therefore, continuously biases the plate member 51 in an upward direction, as viewed in FIG. 2. Thus, should a shorter coil 12 replace the illustrated coil, minor variations in size can be accommodated by the plate member 51 being urged or slid upwardly by the inherent expanding nature of the resilient foam polymeric material 60. Thus, in this fashion, the plate member 51 will be continuously biased or urged into intimate contact with the coil 12 to thereby maintain the gap (unnumbered) heretofore defined between the bottom of the coil 12 and the bottom wall 28 of the primary pan 13 closed and to assure that an upper end of the coil 12 is maintained in intimate contact with an associated supporting surface (not shown) of the fan coil unit housing 11.

Although a preferred embodiment of the invention has been specifically illustrated and described herein, it is to be understood that minor variations may be made in the apparatus without departing from the spirit and scope of the invention, as defined the appended claims.

I claim:

1. A fan coil unit comprising a primary pan, means for defining an air passage in said primary pan, a condensation coil positioned generally above said primary pan, fan means for directing air from an area below said primary pan through said air passage to an area above said primary pan, a gap between a lower edge portion of said condensation coil and said primary pan, means for bridging said gap and generally preventing air from passing therethrough whereby air is essentially forced to travel from the area above said primary pan to and through said condensation coil resulting in the formation of condensation upon said condensation coil and its collection by said primary pan, and said bridging means being defined by a slidable connection between said condensation coil and said primary pan.

2. The fan coil unit as defined in claim I wherein said slidable connection is defined in part by a plate upon which rests said condensation coil lower portion, and means for urging said plate in a direction away from said primary pan.

3. The fan coil unit as defined in claim 1 wherein said slidable connection is defined in part by a plate upon which rests said condensation coil lower portion, said plate includes inner and outer surfaces, and means between said inner and outer surfaces for defining a condensation collection chamber.

4. The fan coil unit as defined in claim 1 wherein said slidable connection is defined in part by a plate upon which rests said condensation coil lower portion, said plate includes inner and outer surfaces, and means between said inner and outer surfaces for defining a plurality of condensation collection chambers.

5. The fan coil unit as defined in claim 1 wherein said slidable connection is defined in part by a plate upon which rests said condensation coil lower portion, means for urging said plate in a direction away from said primary pan, and said urging means is defined by flexible polymeric material.

6. The fan coil unit as defined in claim 1 wherein said slidable connection is defined in part by a plate upon which rests said condensation coil lower portion, means for urging said plate in a direction away from said primary pan, and said urging means is defined by flexible polymeric foam material.

7. The fan coil unit as defined in claim 1 wherein said slidable connection is defined by a pair of relatively telescopic members.

8. The fan coil unit as defined in claim 1 wherein said slidable connection includes a first portion carried by a plate in telescopic relationship to a second portion carried by said primary pan, and said plate is in underlying supporting relationship to said condensation coil lower portion.

9. The fan coil unit as defined in claim 1 wherein said slidable connection includes a first portion carried by a plate in telescopic relationship to a second portion carried by said primary pan, said plate is in underlying supporting relationship to said condensation coil lower portion, and means disposed generally between said primary pan and said condensation coil lower portion for urging said plate in a direction away from said primary pan.

10. The fan coil unit as defined in claim I including biocide means associated with said condensation pan.

11. The fan coil unit as defined in claim 1 wherein said slidable connection is defined in part by a polymeric material plate upon which rests said condensation coil lower portion, and biocide means associated with said plate for absorption by condensate dripping thereupon from said condensation coil to thereby reduce microbiological attack.

12. The fan coil unit as defined in claim I wherein said slidable connection is defined in part by a polymeric material plate upon which rests said condensation coil lower portion, and biocide means generally homogeneously admixed within the polymeric material of said plate which will be leached therefrom by condensation dripping from said condensation coil to thereby reduce microbiological attack.

13. The fan coil unit as defined in claim 2 wherein said plate is constructed from polymeric material, and biocide means generally homogeneously admixed within the polymeric material of said plate which will be leached therefrom by condensation dripping from said condensation coil to thereby reduce microbiological attack.

14. The fan coil unit as defined in claim 3 wherein said plate is constructed from polymeric material, and biocide means generally homogeneously admixed within the polymeric material of said plate which will be leached therefrom by condensation dripping from said condensation coil to thereby reduce microbiological attack.

15. A fan coil unit comprising a primary pan, means for defining an air passage in said primary pan, a condensation coil positioned generally above said primary pan, fan means for directing air from an area below said primary pan through said air passage to an area above said primary pan, a gap between a lower edge portion of said condensation coil and said primary pan, means for bridging said gap and generally preventing air from passing therethrough whereby air is essentially forced to travel from the area above said primary pan to and through said condensation coil resulting in the formation of condensation upon said condensation coil and its collection by said primary pan, said bridging means being defined by a polymeric material plate between said condensation coil and said primary pan, and biocide means generally homogeneously admixed within the polymeric material of said plate which will be leached therefrom by condensate dripping from said condensation coil to thereby reduce microbiological attack.

16. The fan coil unit as defined in claim 15 including means between said primary pan and said plate for urging said plate in a direction away from said primary pan.

17. The fan coil unit as defined in claim 15 including means between said primary pan and said plate for urging said plate in a direction away from said primary pan, and said urging means is defined by resilient polymeric material.

18. A fan coil unit comprising a primary pan, means for defining an air passage in said primary pan, a condensation coil positioned generally above said primary pan, fan means for directing air from an area below said primary pan through said air passage to an area above said primary pan, a gap between a lower edge portion of said condensation coil and said primary pan, means for bridging said gap and generally preventing air from passing therethrough whereby air is essentially forced to travel from the area above said primary pan to and through said condensation coil resulting in the formation of condensation upon said condensation coil and its collection by said primary pan, said bridging means being defined by a plastic material plate between said condensation coil and said primary pan, said plate includes inner and outer surfaces, and means between said inner and outer surfaces for defining a condensation collection chamber.

19. A fan coil unit comprising a primary pan, means for defining an air passage in said primary pan, a condensation coil positioned generally above said primary pan, fan means for directing air from an area below said primary pan through said air passage to an area above said primary pan, a gap between a lower edge portion of said condensation coil and said primary pan, means for bridging said gap and generally preventing air from passing therethrough whereby air is essentially forced to travel from the area above said primary pan to and through said condensation coil resulting in the formation of condensation upon said condensation coil and its collection by said primary pan, said bridging mean being defined by a plastic material plate between said condensation coil and said primary pan, said plate includes inner and outer surfaces, and means between said inner and outer surfaces for defining a plurality of condensation collection chambers.

20. The fan coil unit as defined in claim 18 including biocide means generally homogeneously admixed within the polymeric material of said plate which will be leached therefrom by condensate dripping from said condensation coil to thereby reduce microbiological attack.

* * * * *